US005561885A

United States Patent [19]

Zahuranec et al.

[11] Patent Number: 5,561,885

[45] Date of Patent: Oct. 8, 1996

[54] PORTABLE HAND-HELD VACUUM CLEANER

[75] Inventors: Terry L. Zahuranec, North Olmstead; Paul D. Stephens, Cleveland Heights; Robert Salo, Willoughby Hills; Robert Vystrcil, West Farmington, all of Ohio

[73] Assignee: Royal Appliance Mfg. Co., Cleveland, Ohio

[21] Appl. No.: 372,460

[22] Filed: Jan. 13, 1995

[51] Int. Cl.[6] ..... A47L 5/24; A47L 9/12

[52] U.S. Cl. ..... 15/323; 15/344; 15/339

[58] Field of Search ..... 15/323, 344, 368, 15/373, 339

[56] References Cited

U.S. PATENT DOCUMENTS

| | | | |
|---|---|---|---|
| 2,235,224 | 3/1941 | Lofgren | 15/373 |
| 2,235,225 | 3/1941 | Ross | 15/373 |
| 2,597,808 | 5/1952 | McQuilkin | 15/373 |
| 2,974,346 | 3/1961 | Hahn | 15/344 |
| 4,011,624 | 3/1977 | Proett . | |
| 4,042,999 | 8/1977 | Triantafylloo | 15/323 |
| 4,073,031 | 2/1978 | Schwartz | 15/373 |
| 4,209,875 | 7/1980 | Pugh et al. . | |
| 4,421,964 | 12/1983 | Buchtel . | |
| 4,573,234 | 3/1986 | Kochte et al. . | |
| 4,573,237 | 3/1986 | Kochte et al. . | |
| 4,577,365 | 3/1986 | Yuen | 15/344 |
| 4,610,048 | 9/1986 | Ishihara et al. . | |
| 4,644,605 | 2/1987 | Joss | 15/344 |
| 4,670,701 | 6/1987 | Sako et al. . | |
| 4,704,765 | 11/1987 | Ataka | 15/344 |
| 4,928,347 | 5/1990 | Krasznai et al. . | |
| 4,951,348 | 8/1990 | Krasznai et al. . | |
| 4,967,443 | 11/1990 | Krasznai | 15/344 |
| 5,020,187 | 6/1991 | Kosten | 15/344 |
| 5,025,529 | 6/1991 | Hult et al. . | |

FOREIGN PATENT DOCUMENTS

| | | | |
|---|---|---|---|
| 366608 | 1/1923 | Germany | 15/344 |
| 3309162 | 9/1984 | Germany | 15/344 |
| 2137896 | 10/1984 | United Kingdom | 15/344 |

*Primary Examiner*—David Scherbel
*Assistant Examiner*—Randall E. Chin

[57] ABSTRACT

A portable hand-held vacuum cleaner includes a housing for holding a motor and a suction fan and a switch slidably mounted on the housing for selectively activating the motor. The switch extends out of the housing so as to be manually engageable. A nozzle is mounted on the housing and a release button, pivotally mounted on the housing, selectively releases the nozzle from the housing. The release button includes a first finger which engages an aperture in a wall of the nozzle, a pivot aperture through which extends a pivot pin secured to the housing for enabling the release button to move between a pair of end positions and a biasing element for urging the release button to one of the pair of end positions. A second finger is also provided on the release button. In one of the end positions of the release button, the second finger engages in a recess of the switch to prevent the release button from being pivoted. In another of the end positions of the release button, the second finger engages the switch to prevent the switch from being slid.

24 Claims, 8 Drawing Sheets

PORTABLE HAND-HELD VACUUM CLEANER

BACKGROUND OF THE INVENTION

The present invention relates to a vacuum cleaner. More particularly, the instant invention relates to a hand-held battery powered vacuum cleaner.

Portable hand-held cordless vacuum cleaners have become popular for cleaning a variety of surfaces in cars, offices and homes. Such vacuum cleaners are particularly useful for cleaning hard to reach places. Because they are light, such vacuum cleaners are also advantageous for performing small cleaning jobs where larger vacuum cleaners would be more cumbersome to use.

Vacuum cleaners, especially portable ones, usually include a rigid nozzle or dust bowl attached to a motor unit. The nozzle is detachable so that it may be separated from the motor unit for emptying. Some prior art vacuum cleaners include a locking mechanism consisting of a combination of an upper latch on the motor unit for engaging an opening in a top edge of the nozzle and fixed projections on the motor unit for engaging openings in a bottom edge of the nozzle. To unlock the nozzle, it is necessary to first release the latch mechanism at the top edge of the nozzle and then to disengage the openings from the fixed projections holding the bottom edge of the nozzle.

One advance over this design provides a nozzle for a hand-held vacuum cleaner which is attached to a motor unit using top and bottom latches which are actuated by pushing a single actuation button via a wishbone shaped pusher. This transmits mechanical actuation forces from a latch actuation button operating an upper latch to a spring bar connected to a bottom latch cam. There is also known a rechargeable vacuum cleaner having a nozzle latch button which is located near a motor switch and in which a part of the motor switch is in sliding overlying position relative to the latch button so as to help retain the latch button in a motor housing when the parts are assembled. However, in such vacuum cleaners, the motor switch and the nozzle latch button are not interconnected so that the motor can be actuated by the motor switch even if the nozzle is not securely latched to the motor housing. Also, the latch button could be inadvertently actuated after the motor has been turned on by the motor switch.

Because the known battery powered portable vacuum cleaners have a single nozzle, they are incapable of providing access to narrow crevices where a wand would be necessary. There is one known battery powered vacuum cleaner which has a mouth comprising a telescoping tube of two or more sections wherein one section is extendable outside the nozzle. However, this design is expensive and rather cumbersome as it requires the nozzle to have several additional components. There is also known a vacuum cleaner having an auxiliary nozzle which, when not in use, is supported by a recharging base of the vacuum cleaner. But when the portable vacuum cleaner is used at a location remote from its charging base and the nozzle is needed, it is inconvenient to have to return to the charging base in order to retrieve the nozzle.

There are known cordless portable vacuum cleaner designs which provide a cleaning brush adjacent the nozzle to allow a brushing up of dirt particles to enable them to be more easily sucked in by the nozzle. However, in these known designs, the cleaning brush is fixed on the nozzle and cannot be retracted into the nozzle when not needed or when its use would be counterproductive. There is also known a cordless hand vacuum cleaner which has an auxiliary brush tool that can be selectively connected to the nozzle. When not in use, the brush tool is not held on the vacuum cleaner but needs to be stored at some other location. This is inconvenient when the brush is needed at a particular time during a cleaning chore performed with the vacuum cleaner.

Accordingly, it has been considered desirable to develop a new and improved cordless hand-held vacuum cleaner which would overcome the foregoing difficulties and others while providing better and more advantageous overall results.

BRIEF DESCRIPTION OF THE INVENTION

In accordance with the present invention, a portable hand-held vacuum cleaner is provided.

More particularly in accordance with this aspect of the invention, the vacuum cleaner comprises a housing for holding a motor and a suction fan and a switch means which is slidably mounted on the housing for selectively activating the motor. The switch means extends out of the housing so as to be manually engageable. A nozzle is mounted on the housing and a release button is pivotally mounted on the housing for selectively releasing the nozzle from the housing. The release button includes a first finger which engages an aperture in a wall of the nozzle, a pivot aperture through which extends a pivot pin secured to the housing for enabling the release button to move between a pair of end positions and a biasing means for urging the release button to one of the pair of end positions. The release button further comprises a second finger which, in one of the end positions of the release button, engages in a recess of the switch means to prevent the release button from being pivoted and which, in another of the end positions of the release button, engages the switch means to prevent the switch means from being slid.

Preferably the biasing means comprises a compression spring which can have one end mounted on a stem extending from the release button and another end located in a socket on the housing. The pivot aperture can be located between the first finger and the biasing means so that the release button is biased into an end position in which the first finger extends into the slot of the nozzle. The vacuum cleaner preferably has a battery mounted in a battery chamber formed in the housing for powering the motor. Preferably the vacuum cleaner has an air inlet opening in the housing and an air filter is mounted over the air inlet opening wherein the air filter comprises a filter pack including a filtering medium having a plurality of pleats and a filter frame in which the filter pack is secured. The air filter can further comprise a circumferential lip which engages an interior wall of the nozzle by a friction fit to hold the filter in place in the nozzle. The switch means can comprise a switch member slidably mounted on the housing and a switch cover slidably mounted on the housing so as to engage the switch member. A wand can be selectively securable to the nozzle over an inlet opening thereof and the housing can comprise a storage socket for accommodating the wand when not in use. If desired, the nozzle can comprise a nozzle housing including a nozzle opening, a brush slidably mounted in the nozzle housing to selectively extend out of the nozzle housing adjacent the nozzle opening and an actuating button secured to the brush and accessible from the nozzle housing to allow a selective extension and retraction of the brush in relation to the nozzle opening.

In accordance with another aspect of the present invention, a portable hand-held vacuum cleaner can be provided.

More particularly in accordance with this aspect of the invention, the vacuum cleaner comprises a housing for holding a motor and a suction fan and a nozzle selectively secured to the housing with the nozzle including a nozzle opening. A wand can be selectively secured to the nozzle over the nozzle opening and a chamber is formed in the housing for accommodating the wand when not in use. A rib is formed on a wall of the housing defining the chamber for frictionally engaging the wand when located in the chamber to hold the wand in the chamber.

In accordance with still another aspect of the invention, a portable hand-held vacuum cleaner is provided.

More particularly in accordance with this aspect of the invention, the vacuum cleaner comprises a housing for holding a motor and a suction fan and a nozzle selectively secured to the housing with the nozzle including an inlet opening. A brush is slidably mounted in the nozzle housing to selectively extend out of the nozzle housing adjacent to the inlet opening. An actuating button is secured to the brush and is accessible from the nozzle housing to allow selected extension and retraction of the brush in relation to the inlet opening.

One advantage of the present invention is the provision of a new and improved portable hand-held vacuum cleaner.

Another advantage of the present invention is the provision of a portable vacuum cleaner which has an interlock between a nozzle release button and a motor power switch to prevent the release button from operating when the power switch has been actuated and to prevent the power switch from activating the motor when the nozzle release button has been actuated.

Still another advantage of the present invention is the provision of a portable hand-held vacuum cleaner which includes a selectively detachable wand member. When desired, the wand member can be secured to the nozzle to provide a small diameter opening enabling the vacuum cleaner to be used in confined areas. When not needed, the wand member can be stored in a storage opening in the motor housing of the vacuum cleaner.

Yet another advantage of the present invention is the provision of a portable vacuum cleaner which has a brush member slidably secured in a nozzle such that the brush member can be selectively actuated as needed. When not needed, the brush member can be retracted into the nozzle.

A further advantage of the present invention is the provision of a hand-held battery powered vacuum cleaner having a filter assembly located over a fan intake in a motor housing. The filter assembly is provided with a filter medium secured to a filter housing that has an integral lip around its periphery. The lip acts as a gasket to seal the filter housing against the nozzle in which it is located. The filter housing and filter can be removed as one unit from the vacuum cleaner for cleaning when the nozzle is detached from the motor housing of the vacuum cleaner.

A yet further advantage of the present invention is the provision of a hand-held battery powered vacuum cleaner in which a nozzle is securely held on a motor housing by the cooperation of a release button on the motor housing with an aperture in the nozzle. The nozzle is held in a substantially air tight manner by the cooperation of a pair of slanted side edges of the nozzle which contact mating surfaces on the motor housing and mating top and bottom edges of the nozzle and the motor housing.

Still further advantages of the present invention will become apparent to those of ordinary skill in the art upon a reading and understanding of the following detailed description of the preferred embodiments.

BRIEF DESCRIPTION OF THE DRAWINGS

The invention may take form in certain parts and arrangements of parts preferred embodiments of which will be described in detail in this specification and illustrated in the accompanying drawings which form a part hereof and wherein.

DETAILED DESCRIPTION OF THE PREFERRED EMBODIMENTS

Figures 2, 2A:
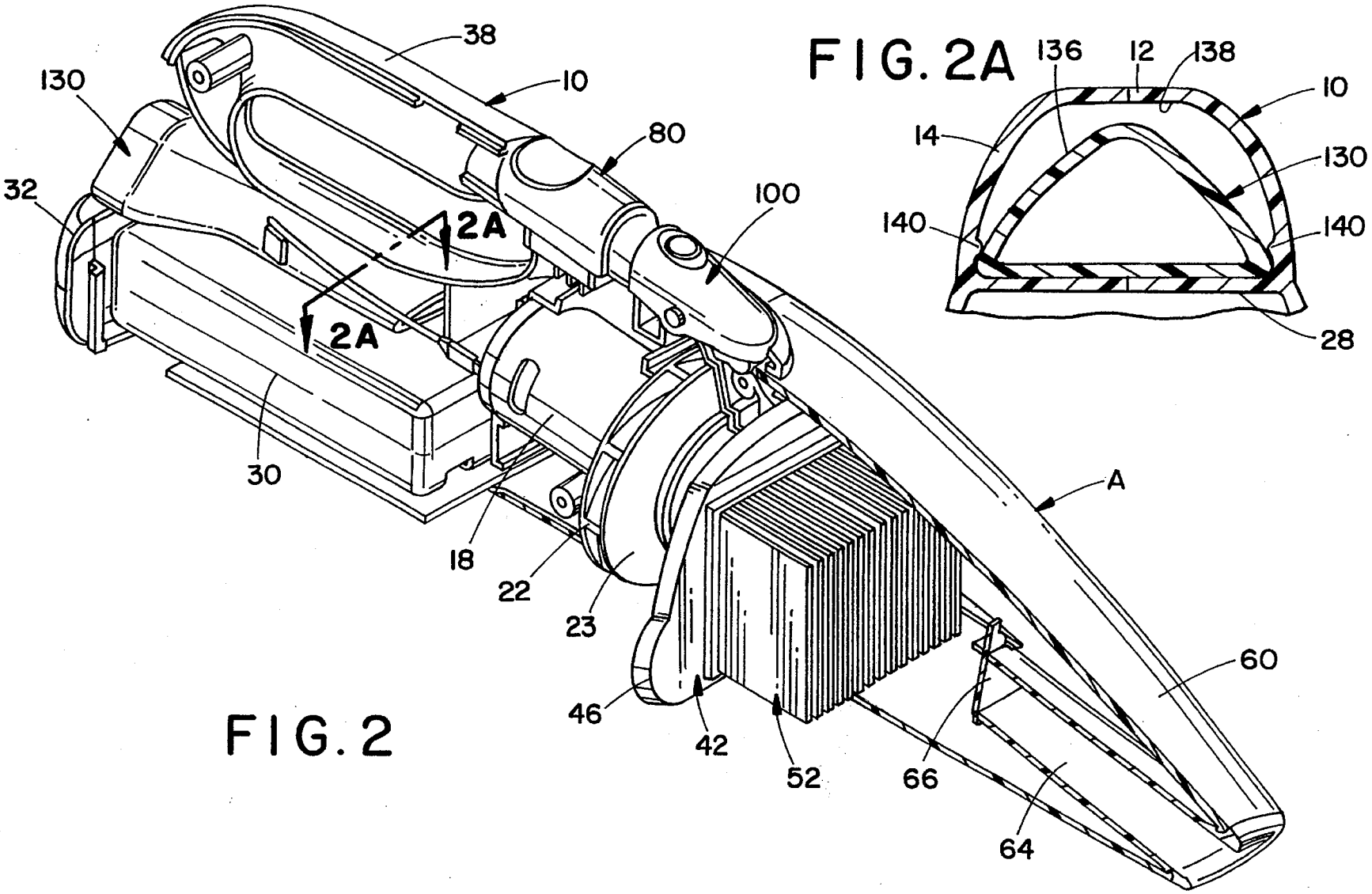
FIG. 2 is an enlarged assembled perspective view of the vacuum cleaner of FIG. 1 with parts of a motor housing and a nozzle broken away so that the interior of the vacuum cleaner can be seen.
FIG. 2A is a side elevational view in cross-section of a portion of the vacuum cleaner of FIG. 2 along lines 2A—2A.

Referring now to the drawings, wherein the showings are for purposes of illustrating preferred embodiments of the invention only and not for purposes of limiting same, FIG. 2 shows the subject new portable hand-held vacuum cleaner A. While the vacuum cleaner is primarily designed for, and will hereinafter be described in connection with a battery powered hand-held vacuum cleaner, it will be appreciated that certain features thereof could also be used on other types of vacuum cleaners such as corded hand-held vacuum cleaners.

Figure 1:
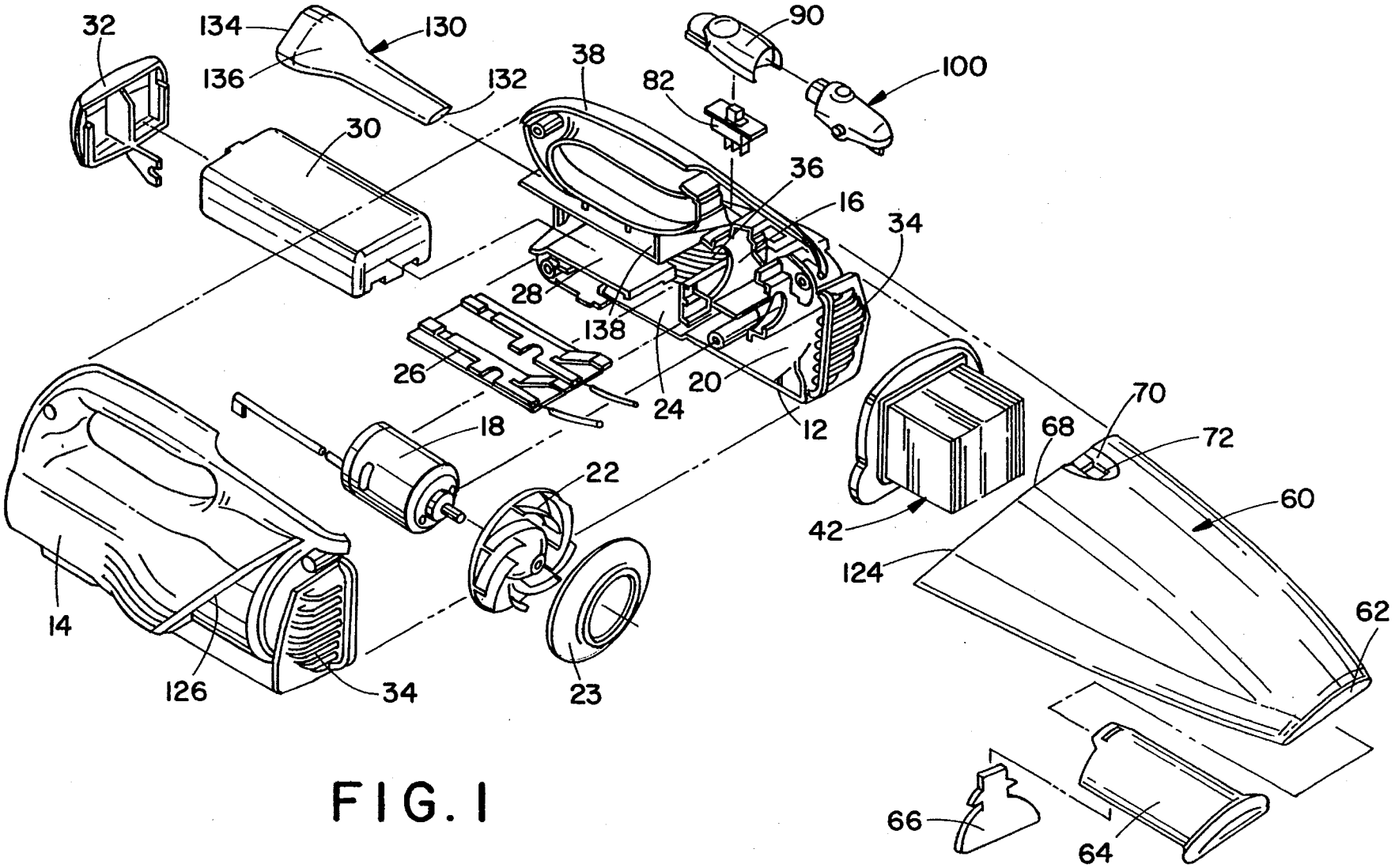
FIG. 1 is an exploded perspective view of a portable hand-held vacuum cleaner according to the present invention.

The vacuum cleaner A comprises a motor housing 10. With reference now also to FIG. 1, the motor housing preferably includes a first shell half 12 and a second shell half 14 which cooperate, when fastened together, to define a motor chamber 16 for housing a motor 18 and a fan chamber 20 for housing a two section fan 22 and 23. The two shell halves also cooperate to define a circuit board chamber 24 for housing a circuit board 26 and a battery chamber 28 for housing a battery 30. A battery cover 32 can be secured behind the shell halves 12 and 14 in order to hold the battery in place. The housing halves each include inlet vents 34 through which air can be pulled in by the fan. Exhaust air from the fan flows through the motor chamber 16 past the motor 18 and is vented through outlet vents 36 provided in both shell halves 12 and 14. The exhaust air from the fan also serves to cool the motor 18. The two shell halves further cooperate to define a handle 38 integral with the housing 10.

If desired, a variety of conventional motors 18 can be employed of different voltages such as 2.4, 3.6, 4.8 or 6.0 volts. Preferably the body halves 12 and 14 are made from a suitable conventional thermoplastic material such as ABS, as is the battery cover 32. If desired, the fan parts 22 and 23 can also be made from a suitable thermoplastic material, such as ABS or a composite of ABS and Triax. The two parts of the fan are secured together by conventional means, such as adhesive or heat welding.

Figure 5:
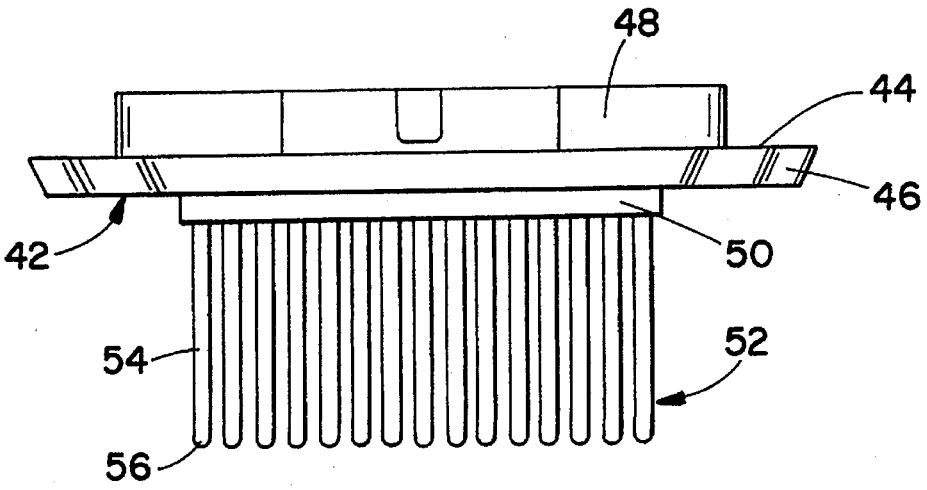
FIG. 5 is an enlarged side elevational view of a filter assembly of the vacuum cleaner of FIG. 1.

Positioned over the air inlet 34 of the motor housing 10 is a filter assembly 42. With reference now also to FIG. 5, the filter housing 42 can include a filter frame 44 having a centrally located aperture 45 (FIG. 11), a circumferentially extending lip 46 as well as a rearwardly extending section 48 and a forwardly extending section 50. Each of these sections extends in a direction approximately normal to the plane of the frame and each section is defined by a wall which extends around the centrally located aperture 45. The forwardly extending section 50 serves as a housing for a filter pack 52.

Figure 6:
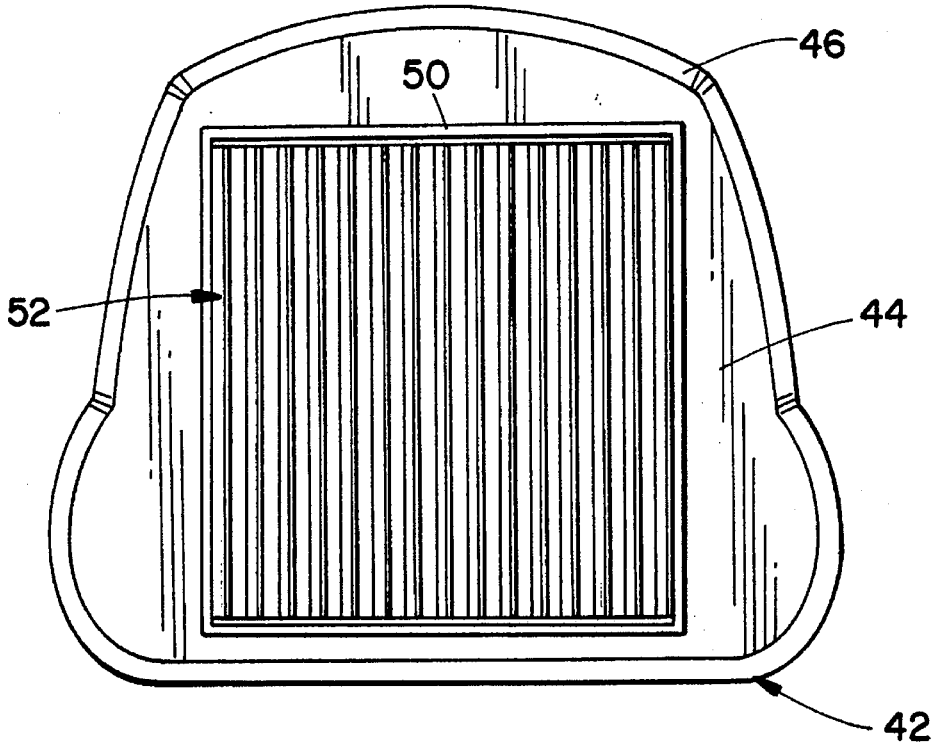
FIG. 6 is an enlarged top elevational view of the filter assembly of FIG. 1.

The filter pack is preferably made of a filter material 54 which is bent to provide a plurality of pleats 56. As is best illustrated in FIG. 6, the filter pack 52 forms a substantially rectangular filtering area over the centrally located aperture 45 of the filter frame 44 so as to be located in front of the inlet 34 of the motor housing 10 when the filter assembly is held in a nozzle of the vacuum cleaner. Preferably the filter material can be a resin impregnated cellulose medium which could have a Frasier air permeability of about 90 cu. ft./minute if desired. Such a material restricts the flow of debris without restricting air flow thereby not interfering with the efficiency of the vacuum cleaner. The filter pack limits debris flow while allowing a relatively free flow of air through the series of closely spaced folded material pleats 56. Such filter material is sold, by among others, the Wix Corporation. In the desired embodiment, about 17 pleats are provided in the filter medium.

Figure 11:
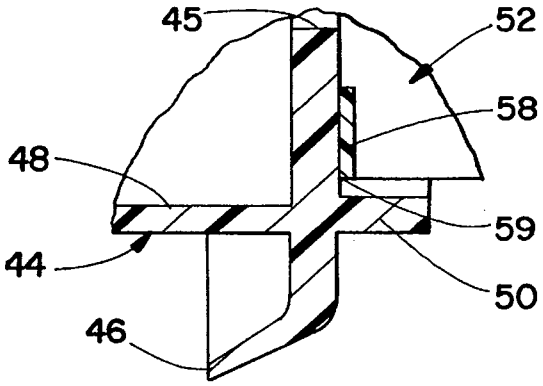

The pleats can be bonded to the filter frame by a conventional adhesive, for example, a hot melt adhesive or a ureathane adhesive. With reference now to FIG. 11, the forwardly extending section 50 of the filter frame 44 is shown as housing the filter pack 52. Securing the filter pack 52 to the filter frame 44 is a bead of adhesive 58 which is located in a recessed area 59 adjacent the periphery of the filter pack 52. The filtration system according to the present invention therefore employs a filter pack adhesively secured to a filter frame which, in use, is sealed along the circumferentially extending lip 46 to the nozzle in which it is seated. Such a filtration system is useable in a unit having an operating air flow of anywhere between 5 and 60 cubic feet per minute and preferably between 20 to 35 cubic feet per minute.

With reference again to FIG. 1, a dirt cup and nozzle 60 can be selectively attached to the motor housing 10. The nozzle 60 includes an inlet end 62 in which is secured a nozzle tube 64. As is conventionally known, the tube 64 has a flapper 66 located at its outlet end. The nozzle 60 has an outlet end 68 in which the filter assembly 42 can be selectively positioned. A depression 70 is located on a top surface of the nozzle 60 adjacent the outlet end 68 thereof. A through aperture 72 is located in the depression 70.

Figure 3:
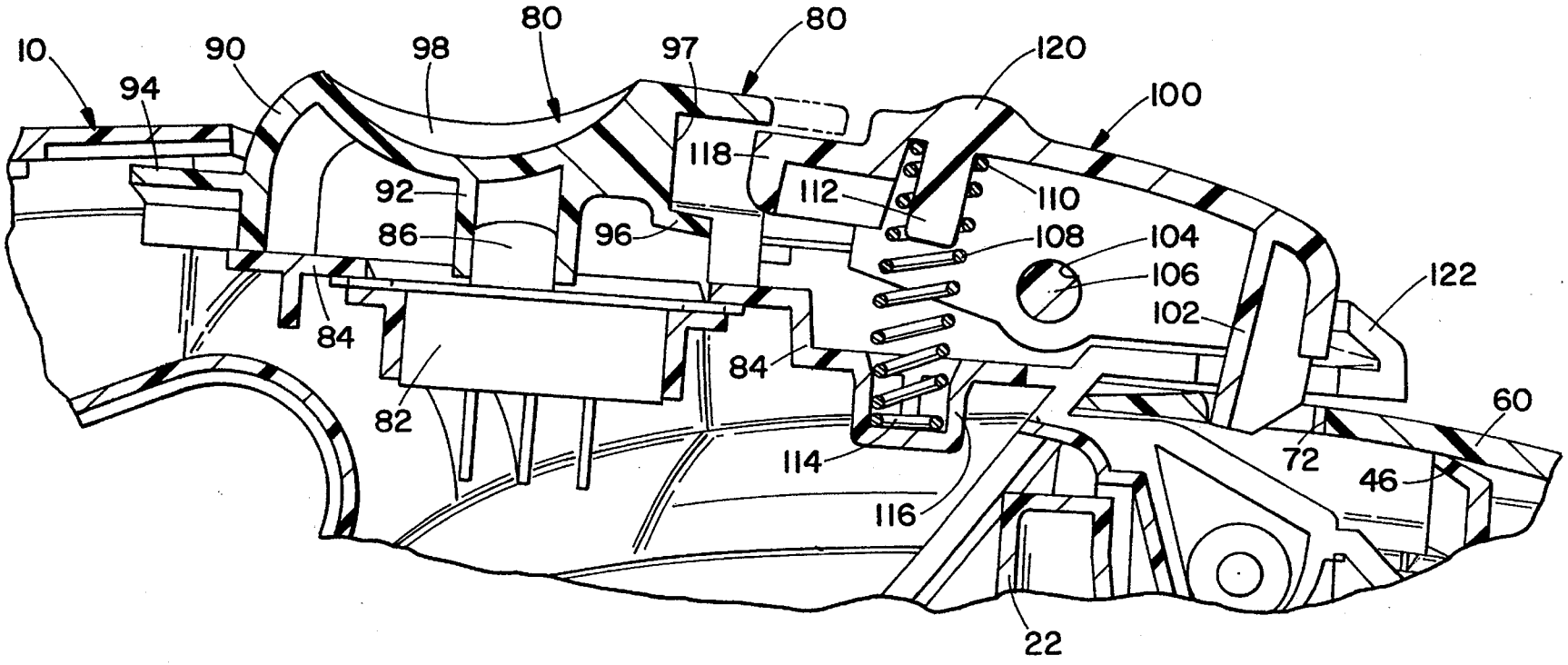
FIG. 3 is a greatly enlarged side elevational view in cross-section of a motor switch and a nozzle release button of the vacuum cleaner of FIG. 1 in a first position.
Figure 4:
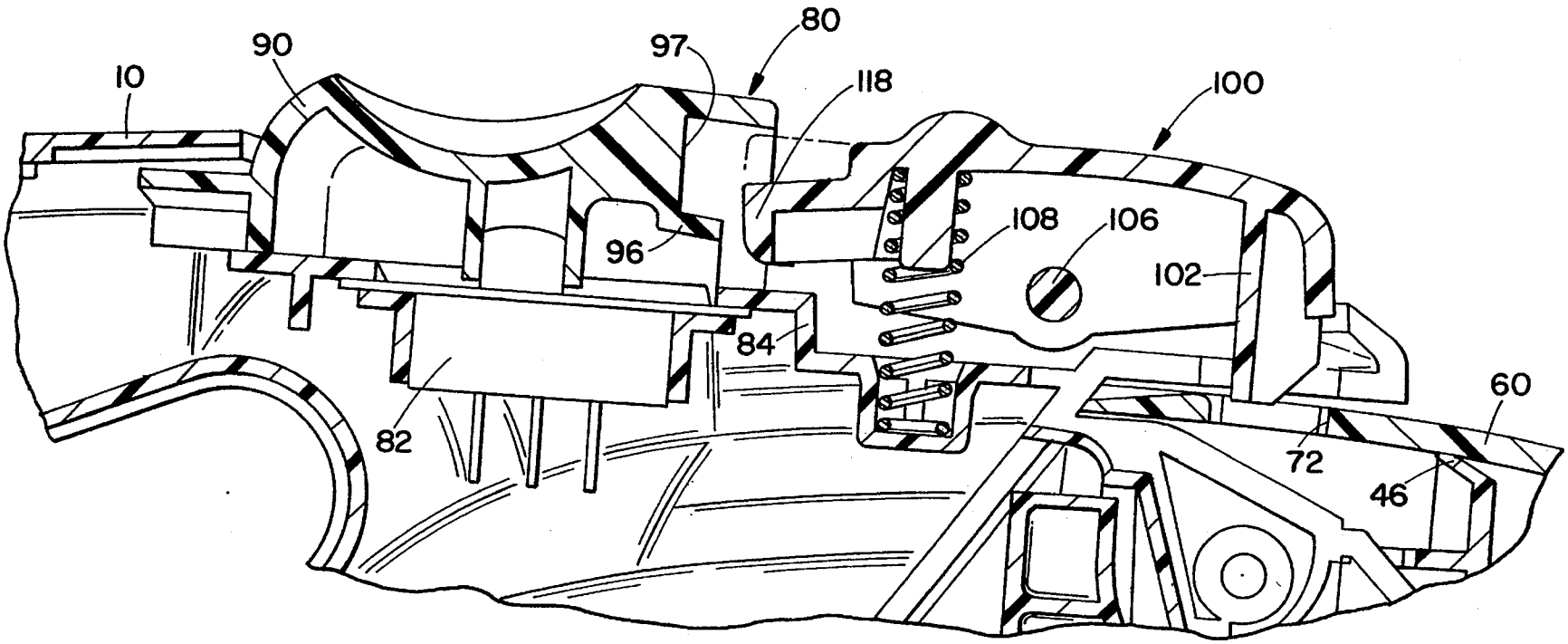
FIG. 4 is a greatly enlarged side elevational view in cross-section of the motor switch and nozzle release button of FIG. 1 in a second position.

The filter frame 44 can seal against the nozzle 60 by suitable flexure of the lip 46 thereof, as is illustrated best in FIGS. 3 and 4. Such sealing contact insures that all of the air flow from the nozzle into the motor housing 10 is through the filter pack 52.

Preferably the nozzle is made from a suitable conventional thermoplastic material such as polyethylene. The nozzle tube can be made from polypropylene and the nozzle flapper can be made from Sanoprene, if desired.

With reference now to FIG. 3, a switch means 80 is located on the motor housing 10 for actuating the motor 18. The switch means comprises a switch member 82 which is slidably mounted on a mounting wall 84 of the housing 10. A handle stub 86 extends upwardly away from the body of the switch. A switch cover 90 cooperates with the switch 82. The switch cover includes a first pair of legs 92 that form between them a first recess or cavity for accommodating the stub 86 of the switch. A protrusion 94 extends rearwardly from the switch cover 90 and is located beneath a wall of the motor housing 10 in order to secure the switch cover 90 in the motor housing. A second pair of legs 96 is defined in a forwardly facing wall of the switch cover 90. The legs 96 form between them a second recess or cavity 97. An upper periphery of the switch cover is provided with a depressed section 98 which is formed for finger contact.

Cooperating with the switch means 80 is a release button 100. The button comprises a first finger 102 which is adapted to selectively extend into the aperture 72 in the nozzle 60. Located in a pair of spaced side walls of the button are pivot apertures 104 through which extends a pivot pin 106 secured at one end to the housing 10. A spring 108 is positioned to the rear of the pivot pin 106. A first end 110 of the spring extends over a stem 112 which protrudes downwardly from the release button 100. A second end 114 of the spring is housed in a socket 116 defined on the mounting wall 84. A second finger 118 extends rearwardly from the body of the release button 100. Provided atop the release button 100 is a raised bump 120 which serves as a finger contact point for the release button. The release button is housed in a forwardly extending housing section 122 of the motor housing 10.

With reference now also to FIG. 4, the switch means 80 and release button 100 interact with each other. More specifically, when the switch means 80 is slid forwardly, the second finger 118 of the release button 100 is positioned within the second cavity 97 of the switch cover 90. Therefore, when the switch cover 90 is slid forwardly, i.e., when the motor is turned on, the release button 100 cannot be pivoted as such pivoting motion is blocked by contact of the second finger 118 with the switch cover 90. Thus, when the motor is turned on, the nozzle 60 cannot be released from the motor housing 10. If the motor switch and the nozzle release button were not interlocked, a finger of the person operating the vacuum cleaner might slip off the motor switch 80 and inadvertently actuate the nozzle release button 100.

When the release button 100 is toggled so as to lift the first finger 102 out of the nozzle aperture 72, thereby releasing the nozzle 60 from the motor housing 10, the switch means 80 cannot be slid forwardly so as to activate the motor. A forward sliding of the switch means 80 is prevented by contact of the release button second finger 118 with the leg 96 of the switch cover 90. The leg 96 defines one wall of the second cavity 97 of the switch cover 90. Therefore, when the nozzle is being detached from the motor housing 10, the switch means 80 cannot be slid forward to activate the motor 18 of the vacuum cleaner.

The nozzle 60 is in a relatively airtight contact with the motor housing 10 due to the cooperation of slanted side walls 124 of the nozzle 60 at its outlet end 68 with suitable flanges 126 located on the exterior periphery of each shell half 12 and 14 (only one of these flanges 126 is visible in FIG. 1). The bottom and top walls of the nozzle 60 are similarly held on the motor housing 10 to form a relatively air tight arrangement and prevent the fan from pulling air from the environment into the motor housing through any crevice formed between the nozzle and the motor housing.

With reference again to FIG. 1, a wand 130 is preferably provided for the vacuum cleaner. The wand has an inlet end 132, an outlet end 134 and an outer periphery 136. A wand chamber 138 is defined by the two motor shell halves 12 and 14 for holding the wand 130 when not in use. With reference now to FIG. 2A, the wand chamber 138 is defined by a pair of motor housing walls, each having an inwardly facing rib 140. These ribs engage the outer periphery 136 of the wand 130 to hold the wand by frictional fit in the wand chamber when not in use. When use of the wand 130 is required, such as when a narrow crevice needs to be suctioned, the wand 130 is removed from the wand chamber 138 and is secured to the front end of the nozzle 60.

Figure 10:
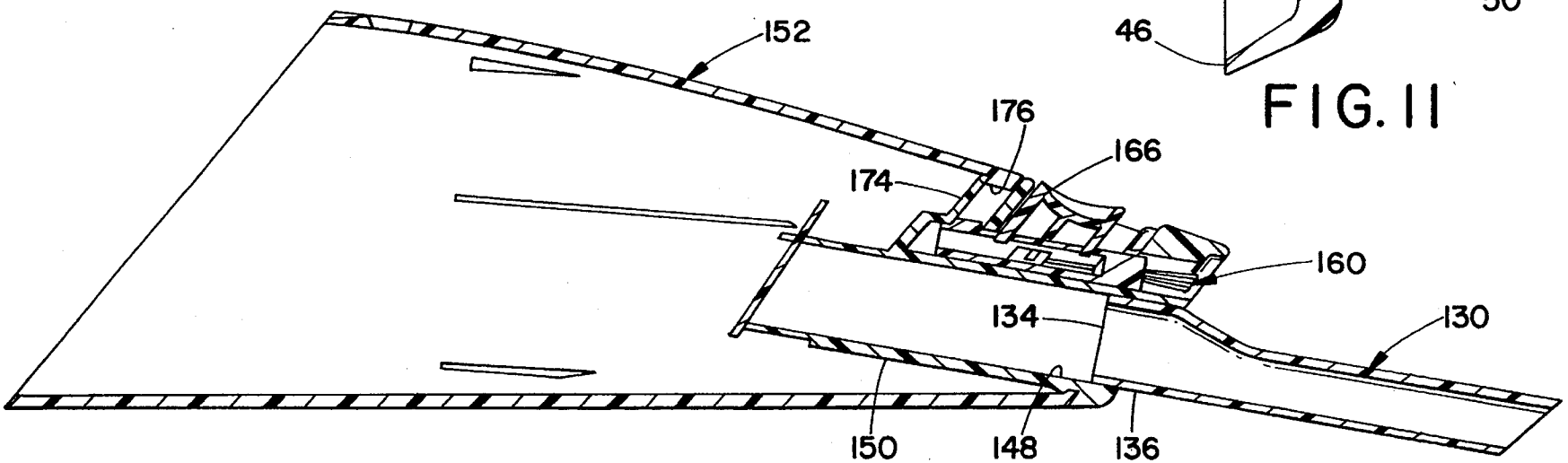
FIG. 10 is a side elevational view in cross-section of the nozzle of FIG. 7 with a wand secured therein and with a brush thereof shown in a retracted position; and, FIG. 11 is a greatly enlarged cross-sectional view through a portion of the filter assembly of FIG. 5.

With reference now to FIG. 10, the nozzle outlet end 134 is shown as being held by frictional fit in an inlet end 148 of a nozzle tube 150 of a deluxe nozzle 152 according to the present invention. The same type of frictional fit between the outer periphery 136 of the wand and the inner periphery of the nozzle tube is obtained when the wand is inserted in the nozzle tube 64 of the nozzle 60 illustrated in FIG. 1. The wand 130 is advantageous when suctioning is required of a crevice into which the inlet end 62 of the nozzle 60 cannot fit. The wand can be made from a suitable thermoplastic material such as styrene. It should be appreciated that a variety of lengths of wand and diameters of wand could be provided as desired just so long as such wand fits in the wand chamber 138 of the motor housing 10.

Figure 7:
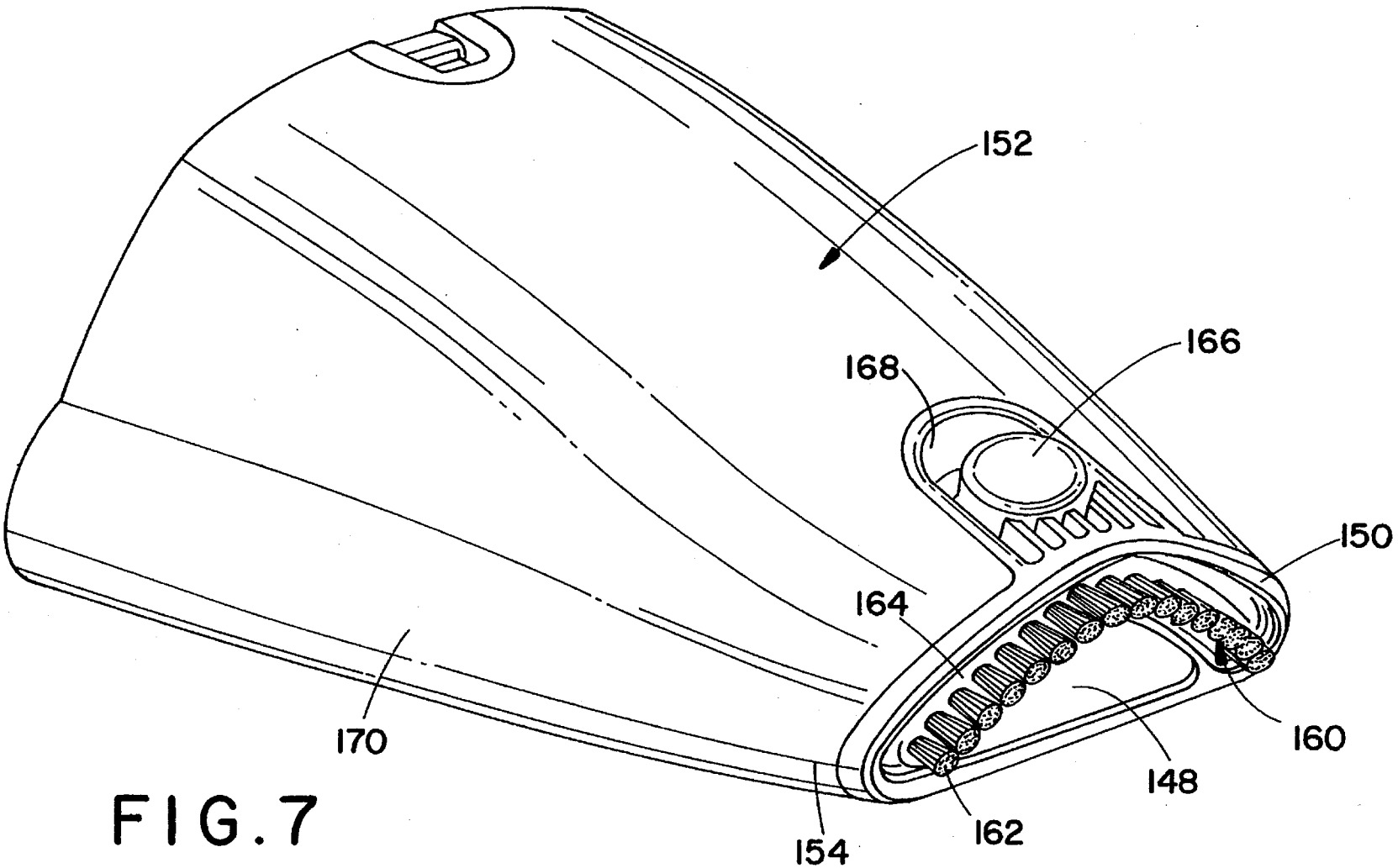
FIG. 7 is a perspective view of a nozzle according to another embodiment of the present invention with a brush of the nozzle shown in an extended position.
Figure 8:
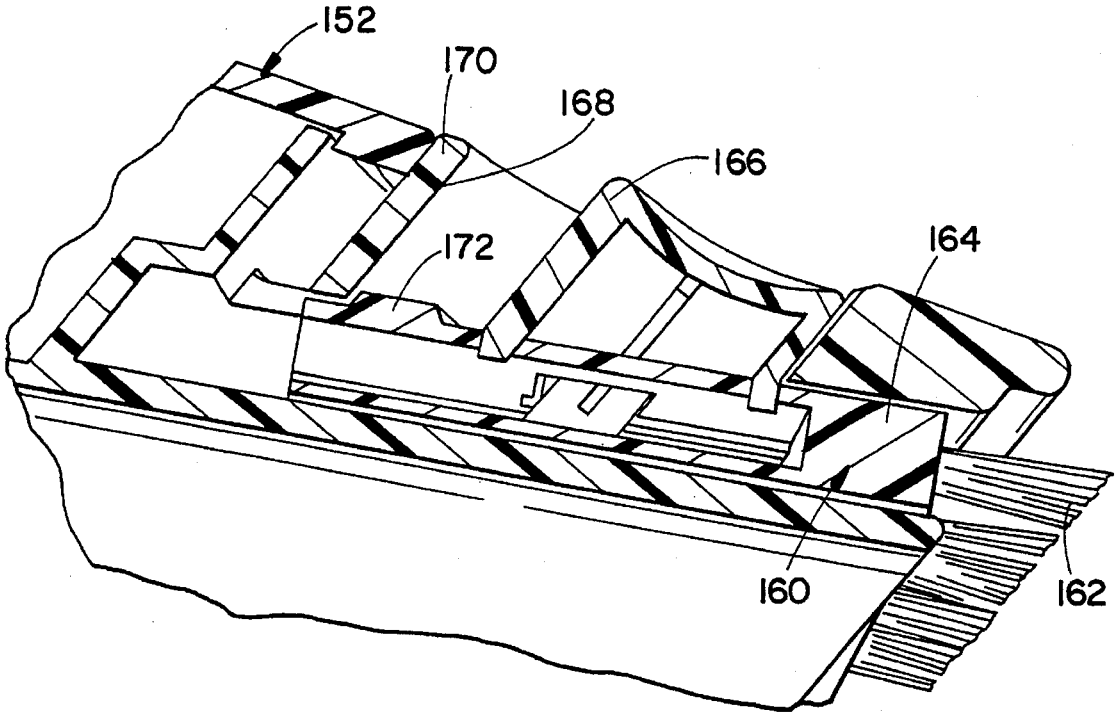
FIG. 8 is a greatly enlarged side elevational view in cross-section of a portion of the nozzle of FIG. 7 in a first position.
Figure 9:
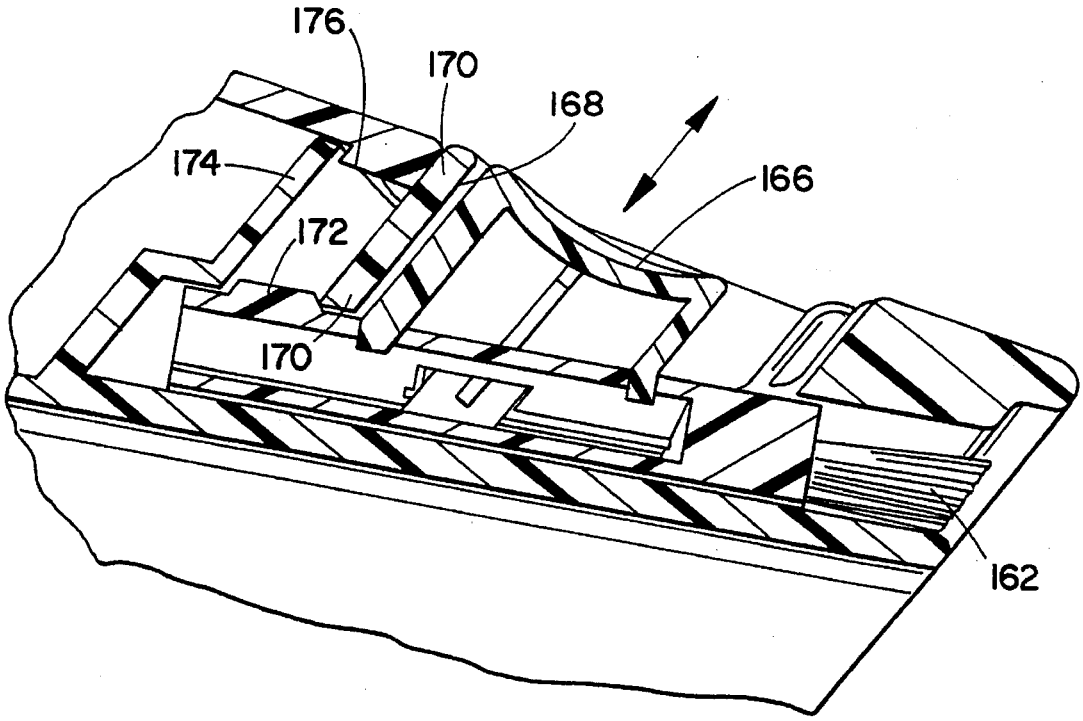
FIG. 9 is a greatly enlarged side elevational view in cross-section of the nozzle portion of FIG. 8 in a second position.

If desired, a brush can be provided for the vacuum cleaner. With reference now to FIG. 7, the deluxe nozzle 152 can include an inlet end 154 in which the nozzle tube 150 is positioned. Secured to the nozzle tube 150 is a brush assembly 160. The assembly comprises a plurality of bristle tufts 162 which are each held in a brush housing 164. With reference now to FIG. 8, the housing has fastened to it an actuation button 166 which extends through an aperture 168 defined in a wall 170 of the nozzle tube 150. A bottom end of the wall 170 cooperates with a ridge 172 of the brush housing 164 to serve as a detent for holding the actuation button 166 either in a forward position as illustrated in FIG. 8 such that the bristle tufts 162 are extended, or in a rearward position as illustrated in FIG. 9, such that the bristle tufts 162 are retracted. This is accomplished by respective locking means defined by opposite sides of ridge 172. In this way, the bristles of the brush assembly 160 can be extended when desired but can also be retracted when not needed.

FIG. 7 of the drawings illustrates that the bristles 162 of the brush assembly 160 form a somewhat V-shaped configuration which is located above the opening 148 of the nozzle tube 150. This configuration of the brush assembly enables its bristles 162 to contact the surface to be cleaned when the vacuum cleaner A is held in its normal acute angle in relation to the surface to be cleaned. The natural hand position of a person employing the vacuum cleaner will place it at an angle of about 45° in relation to the surface to be cleaned.

It should be apparent from FIG. 10 of the drawings that the nozzle tube 150 is different from the nozzle tube 64 illustrated in FIG. 1 in that it has additional structure to accommodate the brush assembly 160 in a slidable manner therein. It can also be seen from FIG. 10 that the nozzle tube includes an upstanding finger 174 which cooperates with a flanged wall 176 of the nozzle 152 in order to secure the nozzle tube in place in the nozzle.

The invention has been described with reference to a preferred embodiment. Obviously, modifications and alterations will occur to others upon a reading and understanding of the preceding detailed description. It is intended that the invention be construed as including all such modifications and alterations insofar as they come within the scope of the appended claims or the equivalents thereof.

We claim:

1. A portable hand-held vacuum cleaner comprising:

a housing;

a motor located in said housing;

a suction fan located in said housing;

a switch means slidably mounted on said housing for selectively activating said motor, said switch means extending out of said housing so as to be manually engageable;

a recess located in said switch means;

a nozzle mounted on said housing, said nozzle including a wall and an aperture located in said wall; and, a release button pivotally mounted on said housing for selectively releasing said nozzle from said housing, said release button including:

a first finger which engages said aperture in said wall of said nozzle, a pivot aperture through which extends a pivot pin secured to said housing for enabling said release button to move between a pair of end positions, a biasing means for urging said release button to one of said pair of end positions, a second finger which, in one of said end positions of said release button, engages in said recess of said switch means to prevent said release button from being pivoted and which, in another of said end positions of said release button, engages said switch means to prevent said switch means from being slid.

2. The vacuum cleaner of claim 1 wherein said biasing means comprises a compression spring having a first end and a second end.

3. The vacuum cleaner of claim 2 further comprising:

a stem extending from said release button such that said first end of said spring is mounted on said stem; and, a socket located on said housing such that said second end of said spring is located in said socket.

4. The vacuum cleaner of claim 3 wherein said pivot aperture is located between said first finger and said biasing means so that said release button is biased into an end position in which said first finger extends into said aperture of said nozzle.

5. The vacuum cleaner of claim 1 further comprising a battery chamber formed in said housing and a battery for powering said motor, said battery being mounted in said battery chamber.

6. The vacuum cleaner of claim 1 further comprising:

an air inlet opening in said housing; and, an air filter mounted over said air inlet opening.

7. The vacuum cleaner of claim 6 wherein said air filter comprises:

a filter pack including a filtering medium having a plurality of pleats; and, a filter frame in which said filter pack is secured.

8. The vacuum cleaner of claim 7 wherein said nozzle further comprises an interior wall and wherein said filter frame comprises a circumferential lip which engages said interior wall of said nozzle by a friction fit to hold said filter in place in said nozzle and to seal against said nozzle.

9. The vacuum cleaner of claim 1 wherein said switch means comprises:

a switch member slidably mounted on said housing;

a switch cover slidably mounted on said housing and engaging said switch member.

10. The vacuum cleaner of claim 1 wherein said nozzle comprises an inlet opening and further comprising a wand which is selectively securable to said nozzle over said inlet opening thereof and wherein said housing comprises a storage socket for accommodating said wand when not in use.

11. The vacuum cleaner of claim 1 wherein said nozzle comprises:

a nozzle housing including a nozzle opening;

a brush slidably mounted in said nozzle housing to selectively extend out of said nozzle housing adjacent said nozzle opening; and, an actuating button secured to said brush and accessible from said nozzle housing to allow a selective extension and retraction of said brush in relation to said nozzle opening.

12. A hand-held vacuum cleaner comprising:

a power unit including a housing;

a motor and a fan located in said housing;

a switch slidably mounted on said housing for controlling said motor, said switch including a recess;

a nozzle mounted on said housing; and, a release button which interacts with said switch, said release button being pivotally mounted on said housing for selectively releasing said nozzle from said housing, said release button including:

a first finger which engages an aperture in a wall of said nozzle, a pivot aperture through which extends a pivot pin secured to said housing for enabling said release button to pivot between a first and a second end position, a spring for urging said release button to said first end position, and a second finger which, in said first end position engages in said recess of said switch to prevent said release button from being pivoted and which, in said second end position, engages a wall of said switch to prevent said switch from being slid.

13. The vacuum cleaner of claim 12 wherein said spring has first and second ends and further comprising:

a stem extending from said release button such that said first end of said spring is mounted on said stem; and, a socket located on said housing such that said second end of said spring is located in said socket wherein said pivot pin is located between said first finger and said spring so that said release button is biased into said first end position.

14. The vacuum cleaner of claim 12 further comprising:

an air inlet opening in said housing; and, an air filter mounted over said air inlet opening wherein said air filter comprises:

a filter pack, and a filter frame in which said filter pack is secured, said filter frame including a circumferentially extending lip which engages said nozzle by a friction fit to hold said filter in place in said nozzle and to seal against said nozzle.

15. A portable hand-held vacuum cleaner comprising:

a housing;

a motor and a fan held in said housing;

a nozzle selectively secured to said housing on one side of said motor, said nozzle including a nozzle opening;

a wand having an end which can be selectively secured to said nozzle over said nozzle opening;

a chamber formed in said housing on an opposite side of said motor from said nozzle for accommodating said wand when said wand is detached from said nozzle; and, a rib formed on a wall of said chamber for frictionally engaging said wand when said wand is inserted in said chamber to hold said wand in said chamber.

16. The vacuum cleaner of claim 15 wherein said nozzle further comprises:

a brush slidably mounted in said nozzle to selectively extend out of said nozzle adjacent said nozzle opening; and, an actuating button secured to said brush and accessible from said nozzle to allow a selective extension and retraction of said brush in relation to said nozzle opening.

17. The vacuum cleaner of claim 15 further comprising:

a nozzle tube mounted in said nozzle opening, said nozzle tube having an inlet end; and a means for holding said wand on said nozzle in said nozzle opening thereof, said means comprising a taper fit of a rear end of said wand with said inlet end of said nozzle tube.

18. A portable hand-held vacuum cleaner comprising:

a housing including an air inlet opening;

a motor held in said housing;

a suction fan held in said housing and communicating with said air inlet opening;

a nozzle selectively secured to said housing over said housing air inlet opening, said nozzle including an inlet opening;

a filter positioned in said nozzle and located adjacent said housing air inlet opening when said nozzle is secured to said housing;

a brush slidably mounted in said nozzle to selectively extend out of said nozzle adjacent said inlet opening; and, an actuating button secured to said brush and accessible from said nozzle to allow a selective extension and retraction of said brush in relation to said inlet opening.

19. The vacuum cleaner of claim 18 wherein said nozzle further comprises:

a wall;

an outlet opening; and, an aperture in said wall of said nozzle adjacent said outlet opening, and wherein said housing comprises a release button, a finger of said release button selectively engaging in said aperture in order to secure said nozzle to said housing.

20. The vacuum cleaner of claim 18 wherein said brush is approximately V-shaped and is located above said nozzle inlet.

21. The vacuum cleaner of claim 18 further comprising a locking means for locking said actuating button in an extended position.

22. The vacuum cleaner of claim 18 further comprising a locking means for locking said actuating button in a retracted position.

23. A portable hand-held vacuum cleaner comprising:

a housing including an inlet opening;

a motor and a suction fan held in said housing;

a nozzle selectively secured to said housing over said inlet opening thereof, said nozzle having a first end, a second end and an interior wall which tapers from said first end toward said second end; and, an air filter assembly mounted in said nozzle over said air inlet opening of said housing, said air filter assembly comprising:

a filter frame having a central through opening and a housing section extending around said through opening;

a pleated filter pack including a filtering medium, said filter pack being located in said housing section of said filter frame so as to cover said through opening;

means for permanently securing said filter pack to said housing section of said filter frame; and, a circumferential lip of one piece with said filter frame, said lip comprising a tapered surface for engaging said interior wall of said nozzle by a sliding friction fit when said air filter assembly is slid from said nozzle first end toward said nozzle second end to hold said filter assembly in place in said nozzle and to seal against said nozzle.

24. The vacuum cleaner of claim 23 wherein said filter pack comprises a filtering medium having a plurality of pleats.

* * * * *